US005984295A

United States Patent [19]

Britz

[11] Patent Number: 5,984,295

[45] Date of Patent: Nov. 16, 1999

[54] PAPER TRAY WITH SINGLE SHEET FEEDER

[75] Inventor: Todd A. Britz, Lakeville, Minn.

[73] Assignee: Primera Technology, Inc., Eden Prairie, Minn.

[21] Appl. No.: 08/924,624

[22] Filed: Sep. 5, 1997

[51] Int. Cl.[6] ..... B65H 3/30

[52] U.S. Cl. ..... 271/22; 271/170

[58] Field of Search ..... 271/21, 22, 169, 271/170

[56] References Cited

U.S. PATENT DOCUMENTS

| | | | |
|---|---|---|---|
| 3,713,645 | 1/1973 | Ferrari et al. | 271/21 |
| 4,216,482 | 8/1980 | Mason | 346/129 |
| 4,437,780 | 3/1984 | Weber et al. | 400/642 |
| 4,492,371 | 1/1985 | Kan et al. | 271/21 |
| 4,558,858 | 12/1985 | Runzi | 271/22 |
| 5,226,743 | 7/1993 | Jackson et al. | 400/625 |
| 5,261,754 | 11/1993 | Sugiura | 400/636.3 |
| 5,427,462 | 6/1995 | Jackson et al. | 400/579 |

FOREIGN PATENT DOCUMENTS

| | | | |
|---|---|---|---|
| 0084741 | 6/1980 | Japan | 271/22 |
| 403200648 | 9/1991 | Japan | 271/170 |
| 406179542 | 6/1994 | Japan | 271/170 |

*Primary Examiner*—H. Grant Skaggs

*Attorney, Agent, or Firm*—Westman, Champlin & Kelly, P.A.

[57] ABSTRACT

A single sheet feed system for feeding sheets, such as sheets of paper into a printer or other device which use individual sheets, such as a telefax machine or copier, is mounted on a tray that has a spring loaded bottom wall to urge a stack of sheets upwardly toward feed rollers. Scissor catches are provided at the leading edge corners and include stop and lift guides which will induce buckling of the corners of a sheet as the sheet is fed. The sheet is also guided by feed blocks adjacent the scissor catches, so that as the sheet is moved toward the printer the corners of a top sheet are caused to buckle and separate from the rest of the stack of sheets without allowing a second sheet to release from the tray as the top sheet is feeding into the printer. The stop and lift guides of the scissor catches cause top sheet to first slide upwardly and then the corners are retained and held from upward movement, so that buckling occurs adjacent corner portions of the top sheet along a leading edge to move the top sheet upwardly away from the stack. The buckled corners of the top sheet then slide along a guide edge. The scissor catches will release the buckled corners as the top sheet is fed further, to insure that only a single sheet is fed each time.

15 Claims, 6 Drawing Sheets

12
34
M
28
30
39
39A
39B
39C
40
36
52
52A
52B
50
14
18
64
3
3
22
26
48
80
38
19
20
24
10

PAPER TRAY WITH SINGLE SHEET FEEDER

BACKGROUND OF THE INVENTION

The present invention relates to a single sheet feeder for use in a paper tray which will reliably feed single sheets each time the paper drive is activated. The corners of the top sheet in a stack are caused to buckle and separate from the rest of the sheets in the stack.

Various sheet feeders for printers and copiers have been advanced in the prior art. It is common to use a spring loaded plate in a tray that will urge a stack of sheets of papers up against catches in the corners. A drive roller will then cause the top sheet to be advanced while the corners are retained until the sheet is pulled out. The prior sheet feeders will generally work satisfactorily until there is an imperfect sheet, or a different type or stiffness of sheet is used and then misfeeds occur.

This is particularly troublesome in printers that use high quality, expensive paper or sheets of different materials of one kind or another.

Thus, the need exists for a single sheet feeder that works reliably regardless of imperfections and changes in the type of sheet being fed.

SUMMARY OF THE INVENTION

The present invention relates to a single sheet feed for a printer sheet storage tray which has a powered sheet feed roller that will engage a top sheet on a stack of sheets. The sheets are supported on a spring loaded tray which urges the sheets upwardly against the sheet drive roller. The drive roller is then powered whenever a sheet is to be fed.

In the present invention as the feed rollers are driven, the leading edges of a top few sheets are lifted at locations spaced in from the sides as they are moved up stop and lift guides positioned inwardly from sides of the sheets. The leading end corners of the sheets are restrained in scissor type catches. As the feed rollers continue to drive a top sheet forwardly, the catches cause the corner portions of the top sheet to buckle and separate from the next to the top sheet.

There are feed blocks that rotatably mount on a cross shaft for the drive roller or rollers. The feed blocks are adjustable laterally of the sheet along the shaft to accommodate many different types of sheets. In all but the innermost lateral position the feed blocks are held in rotational position by a plate to retard the second sheet from buckling and releasing from drag from the top sheet.

The stop and lift guides for the forward or leading edges of the sheets have upright walls that will keep the end edges of the sheets in a stack aligned and will only allow a top few sheets to move ahead at one time. A few top sheets will slide and lift slightly off the sheet stack over tabs as the feed roller is driven, but only the top sheet will buckle for feeding.

The forward edge stops include an inclined top tab that urges the leading edges of the top few sheets upwardly. As the sheets start to move over the top tabs of the stops, the corners engage upright walls of the corner catches. As the feed roller provides drive friction to the top sheet, the leading edges of corners of the top sheet will be restrained by the upright walls of the corner catches, so that the leading edge of the sheet buckles upwardly adjacent the leading edge corners. The corners of the leading edge of the top sheet then slides along top edges of the upright wall as the sheet corners buckle until the top sheet is pulled out of the stack or until the leading edges of the corner portions of the sheet engage stop tabs that stop the front or leading edge of the sheet from further buckling. This will keep the top sheet from buckling too far under in the corners. The buckle upwardly is restrained by the feed blocks, and the top sheet separates from the second sheet and is fed out of the tray as the feed rollers continue to rotate.

The single sheet feeder is easily installed in a supply or storage tray, and relatively economical. It employs the unique combination of front edge stops that have lift tabs that induce buckling in the proper direction, and catch members to cause the corners of the top sheet only to buckle a controlled amount when initially exiting the tray. The individual top sheet is thus separated from the stack. The feeder is usable with paper or other sheet material having a wide range of stiffness, including adhesive backed dye sublimation paper, adhesive backed vinyl and polyester sheets, and adhesive backed plain papers, which include release paper on the adhesive side. Also T-shirt transfer paper is fed with the sheet feeder of the present invention.

DETAILED DESCRIPTION OF THE PREFERRED EMBODIMENTS

Figure 1:
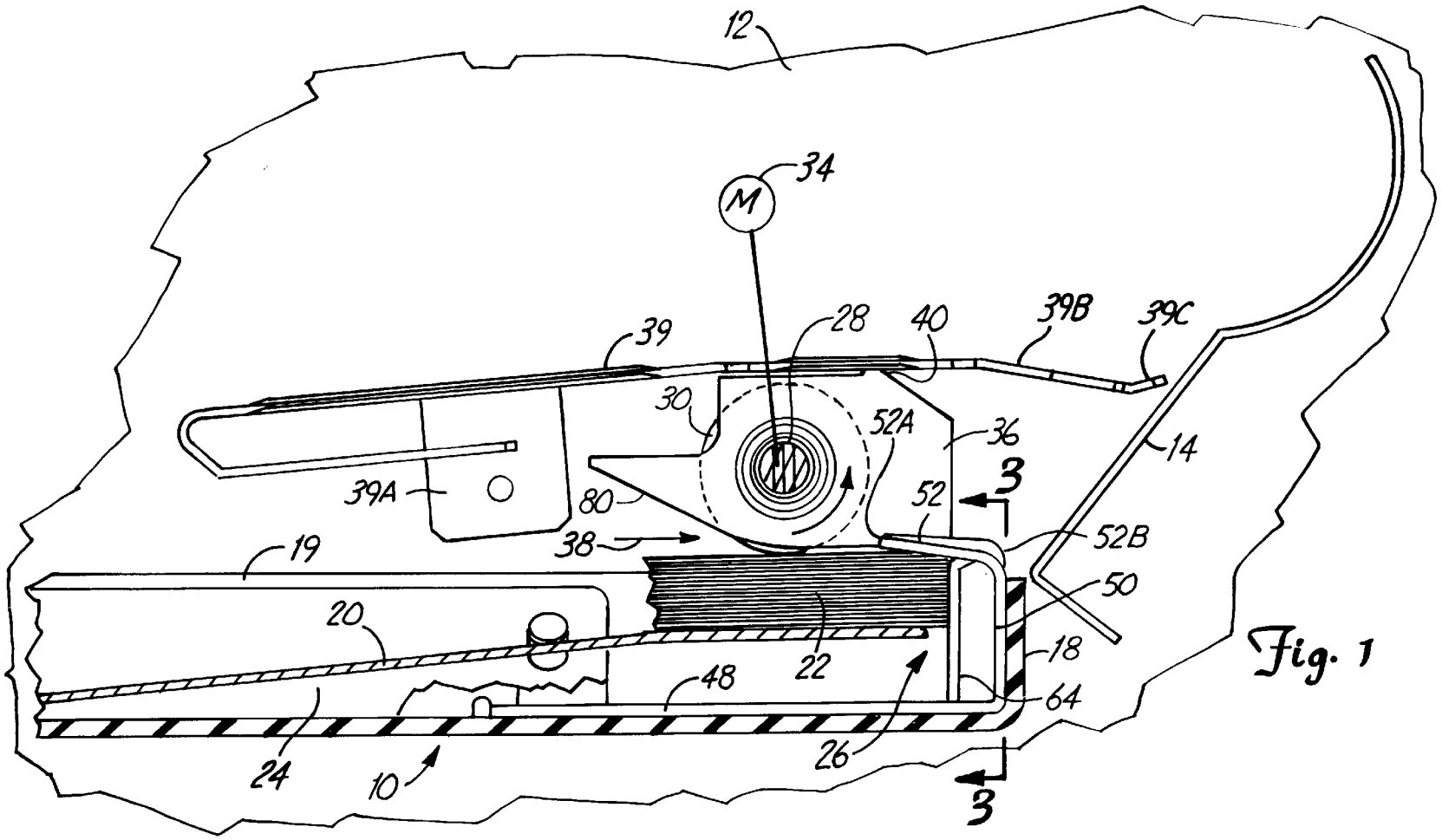
FIG. 1 is a fragmentary side sectional view of a sheet storage tray having a sheet feed system made according to the present invention installed thereon, with parts of a printer shown schematically.
Figure 3:
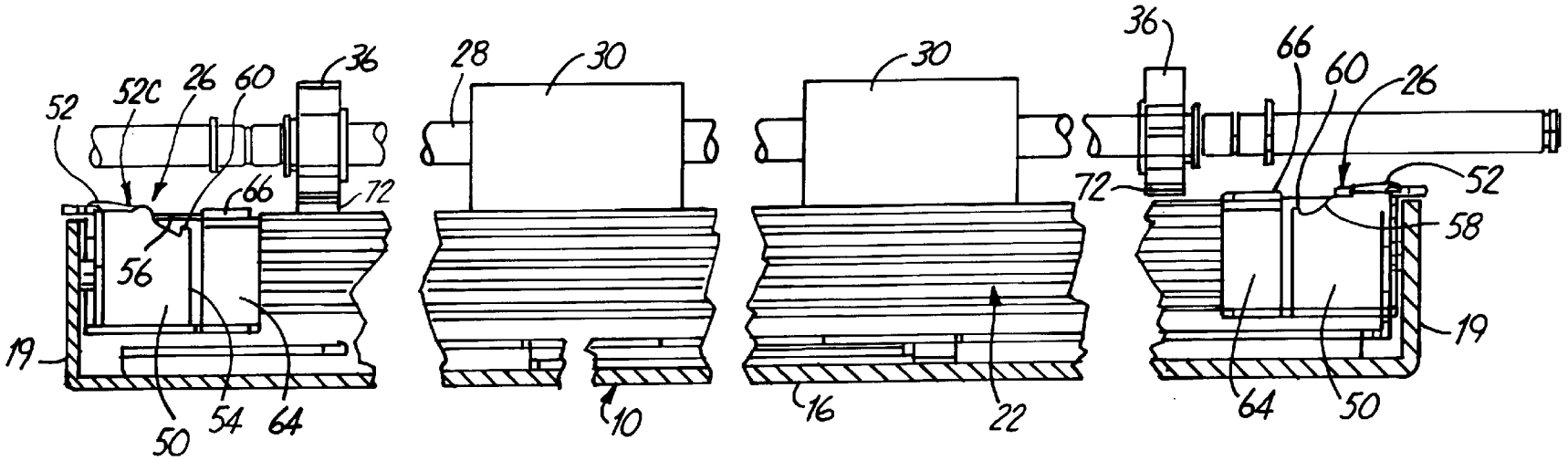
FIG. 3 is a front sectional view showing feed rollers and feed blocks in combination with corner catches, and taken generally along line 3—3 in FIG. 1.

Shown in FIG. 1 without substantial details of construction is a paper tray 10 made according to the present invention. It is mounted in a printer shown broken away at 12, and which includes a platen feed plate 14 that leads to a print head (not shown). The paper tray 10, except for the single sheet feeding arrangement of the present invention is an essentially conventional tray having a bottom wall 16, a feed or front end wall 18, side walls 19 (FIG. 3), and a spring loaded paper support plate 20. The spring loaded support plate 20 is of conventional design, and will support a stack of sheets on which there is to be printing, represented generally at 22 in position within the tray.

Figure 2:
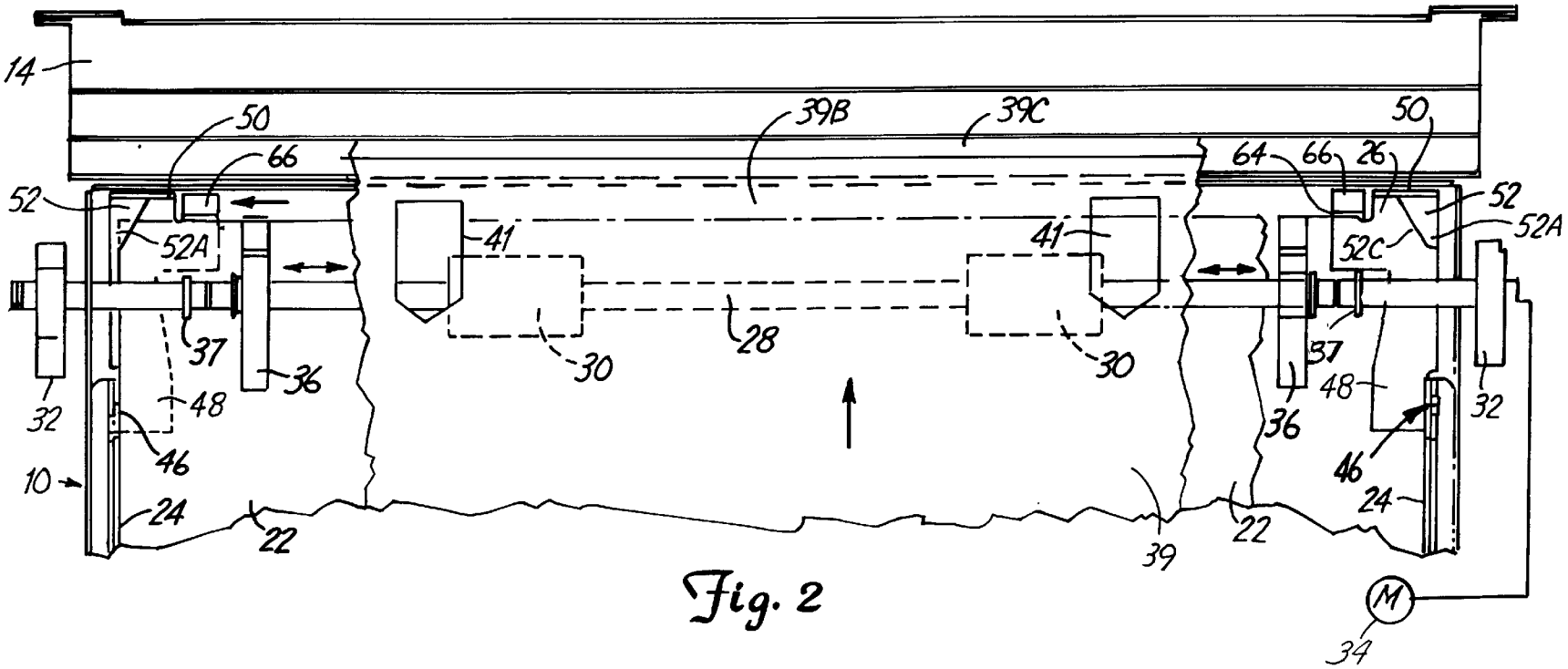
FIG. 2 is a fragmentary top plan view of the sheet feeder of FIG. 1.

As shown in FIG. 2, the tray 10 has sheet side guides 24 for positioning the sheets laterally, and when the sheets are in position in the tray, the leading edges of the sheets are positioned along leading edge catches 26, which are made according to the present invention. The support plate 20 urges the sheet stack 22 upwardly in the catches 26 as well. When the tray 10 is removed from a printer or copier, the sheet stack is held from further upward movement by portions of the catches 26, as will be explained. When in place in a printer or copier, the spring loaded support plate 20 urges the stack of sheets against feed rollers 30.

A feed roller drive shaft 28 for driving the sheet feed rollers 30 is mounted in suitable bearing supports indicated schematically at 32 in FIG. 2, and is driven from a motor 34, also indicated schematically.

The shaft 28 drivably mounts the feed rollers 30, and as can be seen in FIG. 2 the feed rollers are spaced inwardly from the side edges of the sheets to engage the top sheet in the stack 22. The paper stack resiliently engages the feed rollers, under load from the spring loaded plate 20.

The shaft 28 also rotatably mounts a pair of feed blocks 36, 36, which are positioned more closely adjacent the side edges of the sheets than the feed rollers, as shown in FIG. 2. The feed blocks 36 can be adjusted laterally along the shaft 28 between a snap ring 37, that serves as a stop and the adjacent feed roller 30. The feed blocks 36 act through the top sheet to keep the second sheet from buckling and thus insure feeding only the top sheet.

The feed rollers 30 are made in a conventional manner to provide sufficient friction against the top sheet in the stack 22, so that when the shaft 28 is rotated, the feed rollers 30 will also rotate in a counter clockwise direction as shown in FIG. 1 to drag the top sheet off the stack 22 and move it toward the end wall 18 and thus toward the printer platen feed plate 14. This is indicated by the arrow 38 in FIG. 1.

The printer 12 includes an overhead guide plate 39 which is mounted on the suitable bracket 39A to the side of the printer, and this guide plate 39 serves as a guide for sheets being fed upwardly along the platen feed plate 14. As shown in FIG. 1, a forwardly extending end portion 39B of guide plate 39 has a lip 39C that is closely adjacent the surface of the platen feed plate 14.

The feed blocks 36 are rotatably mounted on the shaft 28. As shown the feed blocks are spaced above the stack of sheets when the tray 10 is in usable position. In other words, the top sheet can bulge up slightly before it contacts the feed blocks 36.

Rotation of the feed blocks 36 is resisted by gravity and stopped in most lateral positions by plate 39. Stop lugs or bumps 40 on the feed blocks 36 will engage the plate 39 if the feed blocks start to rotate counter clockwise, except on the inner most position of the feed blocks, when the feed blocks are slid to position adjacent the respective feed roller 30. There are openings 41 in the guide plate 39 adjacent the outer edges of the feed rollers as shown in FIG. 2. When the feed blocks 36 are aligned with the openings 41, they can pivot a limited amount counter clockwise so the forward ends can move upwardly.

The position of the feed blocks 36 along shaft 28 for proper feeding will be determined by the stiffness of the sheets being fed, with the stiffer sheets requiring the feed blocks 36 to be moved toward the adjacent feed rollers, that is, toward this center of the sheets being fed.

Thus, the pivoting of the feed blocks 36 is controlled and they do not pivot counter clockwise very far except in the case of the stiffest sheets, where the blocks are moved adjacent to the feed rollers. At those positions they will pivot upwardly so that the normal upward curve of the top sheet moving on the platen feed plate 14 and being fed to the printer will not have excessive interference. The feed blocks 36 will not cause a significant drag on the top sheet. The scissor catches 26 are on the opposite sides of the tray, and thus are made to engage both of the forward corners of the sheets. The catches 26 mount onto the side of the side paper guides in tray 10. The catches 26 do not move up and down with the spring loaded plate 20. The catches limit upward and forward movement of the sheets in the stack 22.

The catches 26 each include a support plate 48 which is beneath the sheet stack and adjacent the lower wall 16 of the sheet storage tray 10.

Each catch 26 includes an end upright wall 50 that extends upwardly from plate 48 and has an inwardly extending top flange 52 integral therewith at one edge. Each flange 52 is aligned to overlie a respective corner of the sheet stack 22, respectively. The flanges 52 form overhead stops for the sheet stack to resist the load of the spring loaded plate 20 when the tray is removed from the printer, and to guide the corner of the top sheet to buckle as the top sheet is fed. Flanges 52 are inclined upwardly toward an inward tip 52A from its curved or bend junction 52B with the upright wall 50. Each flange 52 has a tapered inner edge 52C that extends between the tip 52A and the upright wall 50. The flanges 52 also incline or tilt upwardly slightly toward the center of the sheets of paper, so each edge 52C is slightly higher that the outer edge of that flange. The tabs thus are canted slightly relative to a plane of the top sheet in the stack 22.

The edge 52C is rounded or curved to blend smoothly with an upper edge section 58 of wall 50 that slopes downwardly from the junction with edge 52C of flange 52 toward the upright edge 54. Edge 58 is steeply inclined and joins a more gently downwardly inclined upper edge surface 56 leading toward the edge 54, as perhaps best seen in FIGS. 5 and 6. The edge 58 is cut as a continuation of the trim angle of the edge 54C when flange 52 is formed in flat layout before the flange 52 is bent down. The bending of the flange 52 relative to wall 50 at 52B is made with a radius to provide a smooth transition between edges 52C and 58.

A stop tab 60 protrudes upwardly from the sloping edge surface 56, adjacent the side edge 54 of the upright wall 50, and as will be explained, the tab 60 serves as a stop for insuring that corner buckling of a sheet will stop as a sheet leading edge slides along the wall edge 56 when a sheet is being fed.

Figure 4:
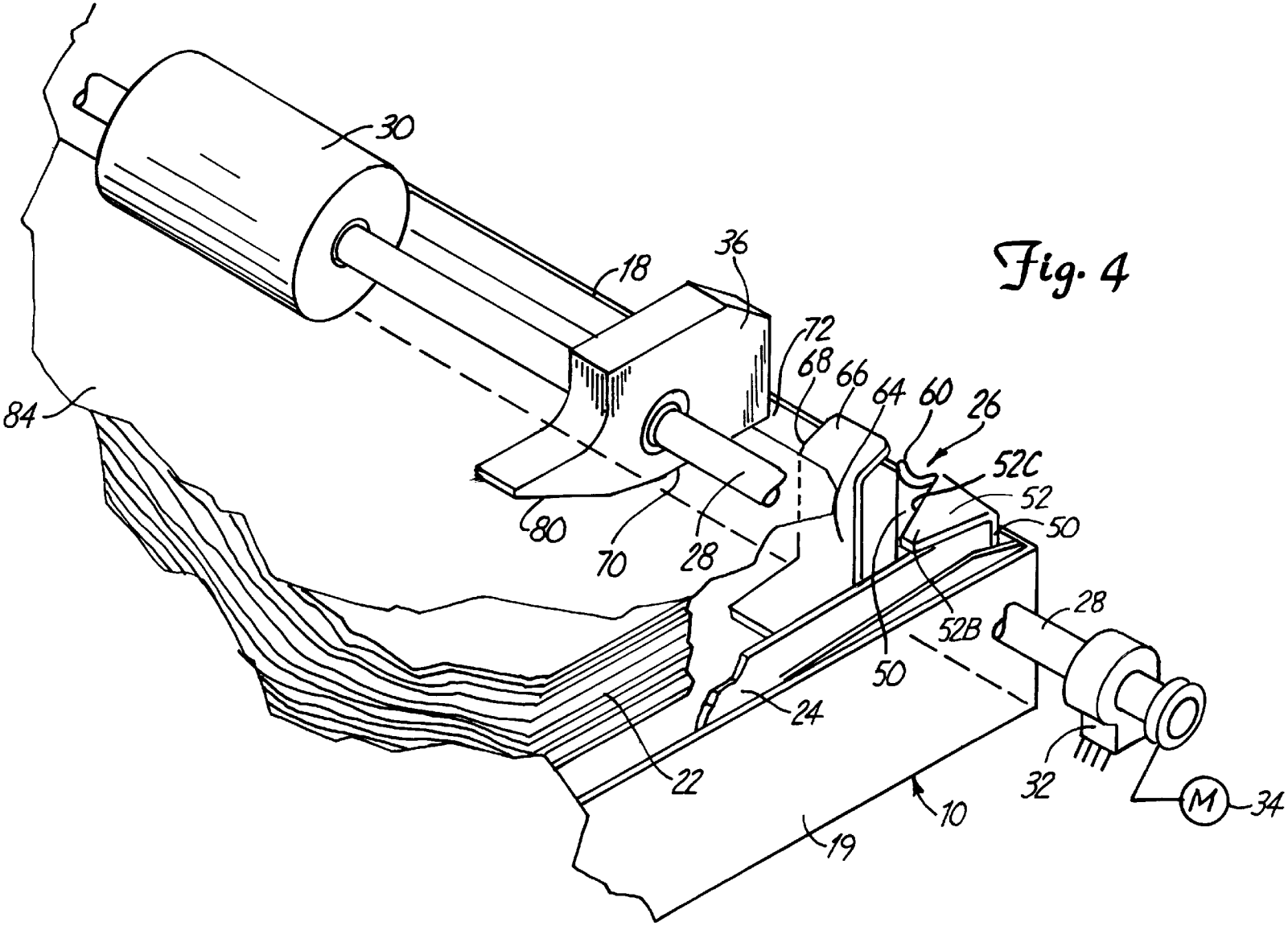
FIG. 4 is a fragmentary perspective view of one corner of a paper tray showing the sheet feeder of the present invention.

The plate 48 also supports an upright sheet stop and lift guide 64 that is positioned inwardly from the walls 50. The upright sheet stop and lift guides thus form the forward end stops to position the sheet stack in the tray. Each stop and lift guide 64 has a upwardly sloping paper leading edge guide and lift tab 66 that is joined to the upright stop and lift guide 64 with a rounded corner shown at 68 (FIG. 4). The rounded corner 68 is vertically aligned with the stack of sheets slightly below the top sheet, so that the leading edges of a few top sheets below the top sheet strike the rounded corner 68 as they drag out of the stack and are guided and lifted as they slide a short distance on the upper surface of the guide and lift tab 66.

The feed blocks 36 have a lower generally planar edge surface 70 above the sheets in the stack 22, with a rounded or tapered front corner 72 that drags under light gravity force on the sheets. The feed blocks 36 have upwardly turned rear guide surfaces 80. The surface 70 of each block 36 will be close to but spaced slightly upwardly from a top sheet 84 in the stack 22. The spacing from the top sheet 84 in the stack 22 is so that the feed blocks will not place a significant drag on the top sheet 84 as the feed rollers feed the sheet, but will hold the top sheet down so the second sheet will not buckle, to prevent the second sheet from feeding with the top sheet.

The feed blocks 36 are normally held in the position shown in FIG. 1 by the guide plate 39, as previously explained, and when positioned laterally close to the respective feed roller 30, the front end of the feed blocks can pivot upwardly on their bearing mountings.

Figure 5:
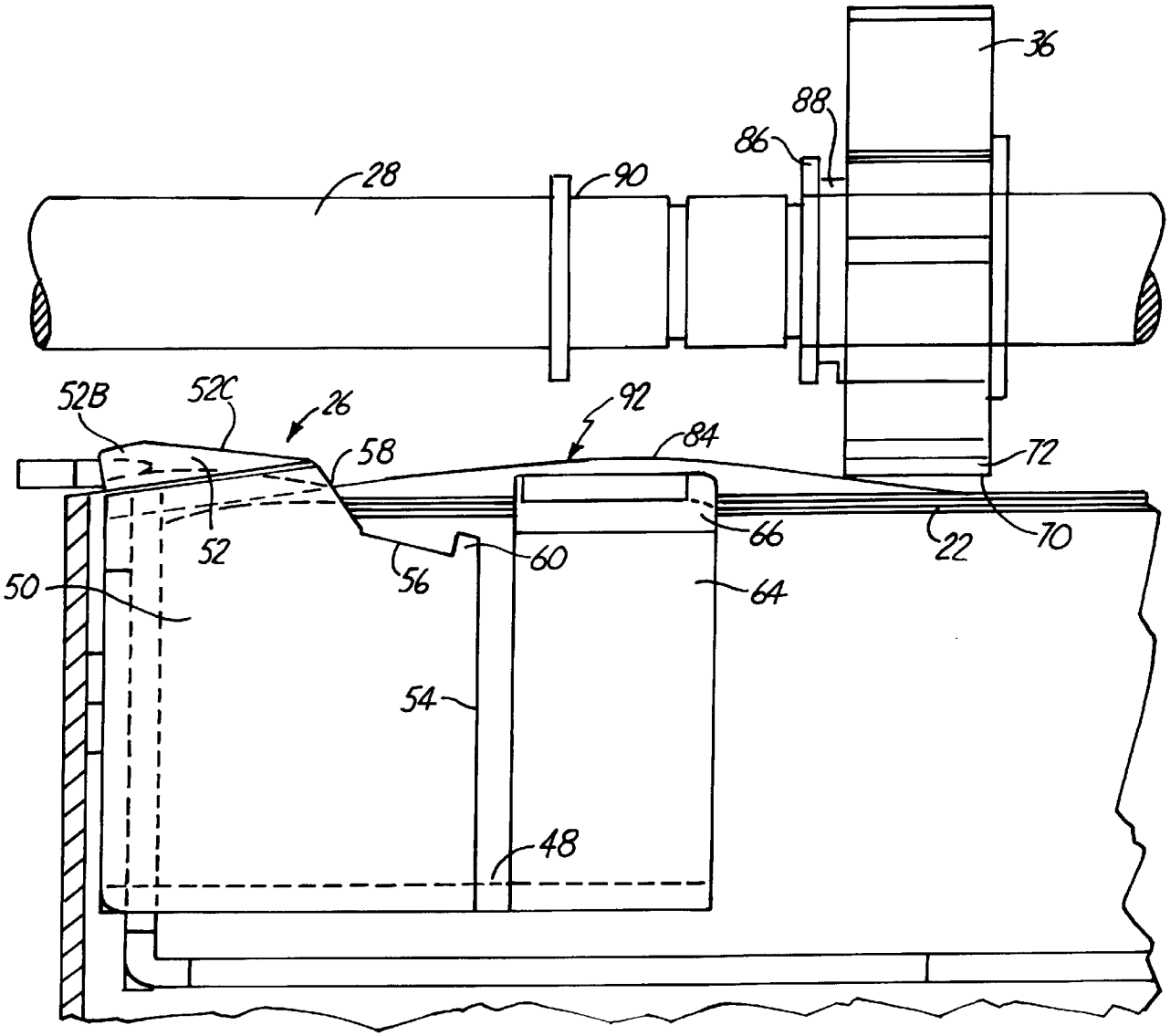
FIG. 5 is a front view of one of the catches used with the present invention, with parts of the paper tray broken away showing the top sheet in its initial induced buckle stage.

The lateral position of the feed blocks 36 is perhaps best seen in FIG. 5, and also as can be seen, the lateral position can be changed by sliding the feed blocks on their bearings 86 along the shaft 28 to a user selected position. The bearings 86 are frictionally held on the shaft but can be slid along the shaft. When the feed blocks 36 are positioned close to the sides of the sheet they operate best with flexible sheets. For stiffer sheets the feed blocks are moved inwardly toward the respective feed roller 30.

The feed rollers 30 are positioned to the interior of the feed blocks 36, on each side of the sheet tray. When the shaft 28 is rotated in response to a feed command by driving the motor 34, the feed rollers 30 will provide a friction driving load against the upper surface of the top sheet 84 and will slide the top sheet 84 from the stack toward the wall 50. A few sheets immediately under sheet 84 also initially move and the sheet edges fan or stagger as they are moved by drag between the top few sheets.

As seen in FIG. 1, the rounded corner 68 of upright stop and lift guide 64 is almost immediately engaged by the leading edges of the top few sheets that are dragged along with top sheet 84. The leading edges of these sheets will be guided by the rounded corner 68 up onto the top surface of the guide and lift tab 66, while the flanges 52 prevent the corners from lifting substantially. The leading edges of the sheets, at a location inward from the corners, thus will start to be lifted or "buckled" as shown at 92 in FIG. 5.

The flanges 52, and particularly the smooth curved corners of the edges 52C where they joins edges 58, will hold the corners of the top sheet 84 down. The top sheet 84 is being directly driven by the feed rollers and corner buckling will occur as the sheets slide farther over the guide and lift tab 66 and the leading edges of the corners engage upright walls 50.

The feeding will continue, rather rapidly, and it can be seen that the feed blocks 36 will tend to keep the center portions of top sheet 84 and second sheet down so that upward movement of the top sheet and buckling of the second sheet is controlled. The rounded bent corner between wall 50 and flange 52 and the smooth junction between edges 52C and 58 permit the leading edge of the top sheet to be moved across these wall edges easily while buckling.

The required lateral positions of the feed blocks 36 depend on the stiffness of the sheets, the frictional characteristics of the sheets in the stack and similar factors. When the feed blocks are at the innermost position, typically with stiffer sheets, they are free to rotate a limited amount counter clockwise so forward ends can move up through slots 41. This is usually for a stiff sheet and as the stiff sheet 84 buckles and moves up plate 14, the feed blocks 36 will rotate in a counter clockwise direction as viewed in FIG. 1 and surface 80 of each block wall lie approximately parallel to the paper stack. Surfaces 70 then incline up and do not add substantially drag on the sheet being fed onto plate 14 so that the sheet bends for feeding as if the feed blocks were not present after the sheet has cleared the scissor catches 26.

Figure 6:
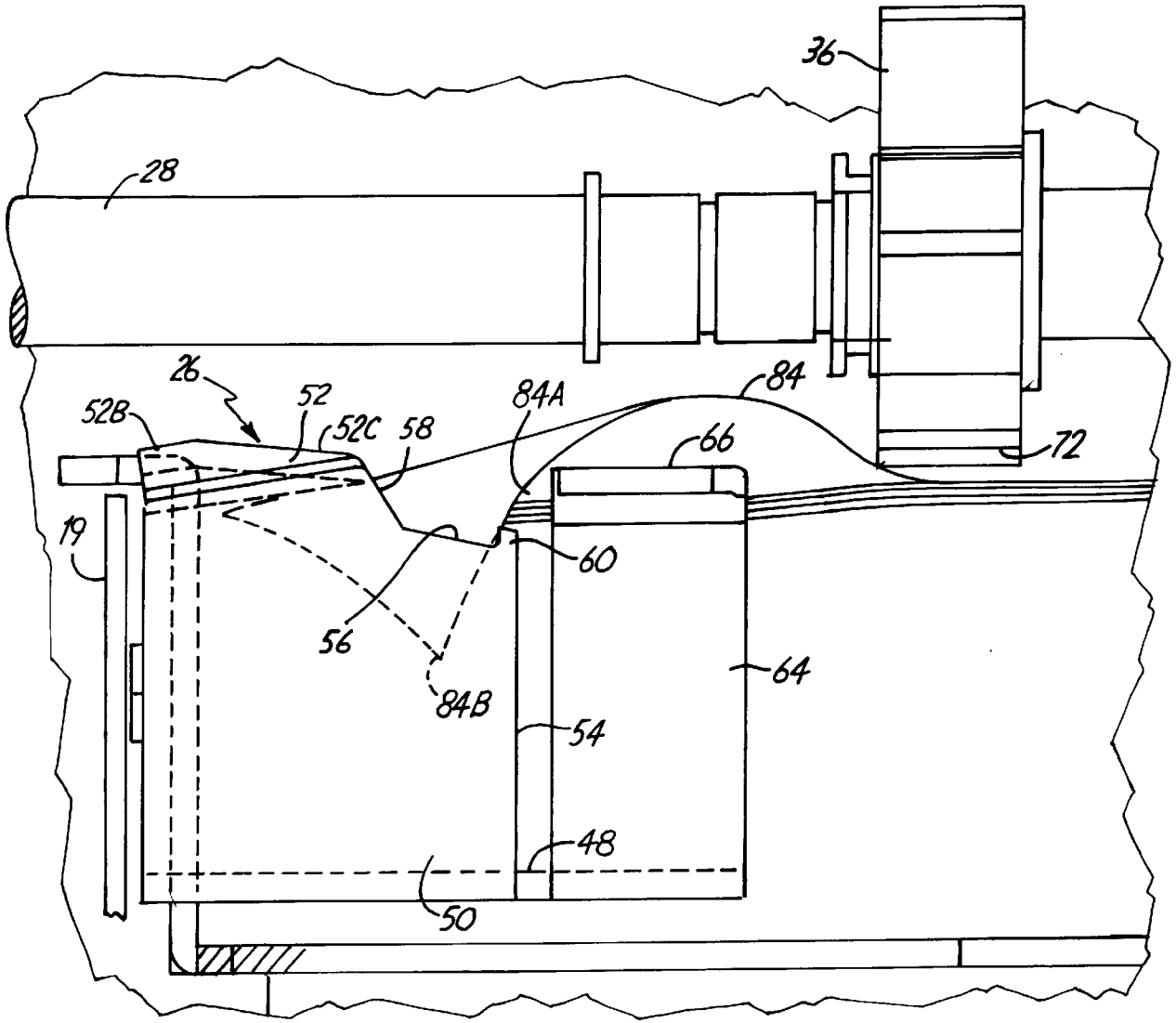
FIG. 6 is a view similar to FIG. 5 showing the top sheet after it has advanced and just prior to release.

FIG. 6 shows the top sheet 84 just before release from the scissor catches, and it can be seen that the sheet leading edge 84A has buckled so that the leading edge has slid along the tapered top edge 56 of wall 50 and is engaging the stop tab 60. The sheet corners will not buckle farther under center parts of the sheet 84. The sheet 84 will be fed toward plate 14 until the corner shown at 84B in dotted lines in FIG. 6 releases either while it is moving along edge 56 and before it contacts stop tab 60, or when it is stopped from buckling by the stop tab 60. In any event buckling will stop and the corner will release when the edge contacts the stop tab 60. The sheet corner will spring outwardly for feeding across the feed plate 14 that leads to the platen of the printer. The action shown in FIGS. 5 and 6 occurs at each of the corners of the sheet so that the entire sheet is fed reliably.

The ability to make the top sheet buckle at the corners so that it separates from the other sheets in the stack 22 permits the feed to occur rapidly, and without misfeeds. The stop tab 60 also stops movement of the second sheet if it is dragged with the top sheet.

The present invention of the scissor catches provides an action that causes a lifting of the leading edges of sheets being fed so the top sheet is predisposed to buckling in the intended direction. The top sheet leading edge corners are subsequently retained as the top sheet is moved along the guide and lift tab. The leading edge of the top sheet corner portions then slide along edges 58 and 56 until released as the sheet feeds. This action minimizes misfeeds even if different stiffness of paper are fed or if there are variation from sheet to sheet. The feed blocks are positioned to accommodate the different stiffness of paper. The feed block adjustment can be made manually.

The guide and lift tabs 66 are close to, but spaced from, the sheet corner retainer flange 52. The edges 52C of the corner retainer tabs 52 guide the corners of the sheet downwardly as the top sheet moves over the guide and lift tabs 66 (and over any other sheets that are dragged partially out of the stack). The tapered top edge surfaces 58 and 56 of walls 50, along which the leading edge of the paper can ride, guide the buckling. The leading edge of the top sheet will be dragged along the inclined surface 56 as it buckles under until it is released. The buckled corner portion will spring back into flat position as it moves to the paper feed guide 14, which is a curved plate that extends the full width of the sheets.

The second sheet in the stack is retained from buckling by the top sheet and the feed blocks, which will limit upward movement of the second sheet. The stop tabs 60 also will act to restrain the second sheet if drag on the second sheet caused by movement of the top sheet slides the second sheet forwardly. The edge of the second sheet may roll under slightly, but since it cannot buckle up, it will not release.

A wide variety of sheet material such as dye sublimation sheets which are adhesive backed, heavy paper and vinyl or polyester sheets, either plain or adhesive backed can be handled.

Although the present invention has been described with reference to preferred embodiments, workers skilled in the art will recognize that changes may be made in form and detail without departing from the spirit and scope of the invention.

What is claimed is:

1. A single sheet feeding arrangement for a sheet holding tray having a spring loaded plate that moves a stack of sheets to position for engagement of a top sheet in the stack with a feed roller that provides a friction load to move the top sheet in a first direction, wherein the improvement comprises a scissor catch assembly including a retainer portion at a corner forming an upright wall blocking movement of a corner portion of the top sheet in the first direction, and an upright sheet edge guide and lift tab spaced laterally inwardly from the retainer portion, whereby movement of the top sheet in the first direction causes a leading edge of the top sheet to be lifted as it passes over the guide and lift tab to lift the leading edge of the top sheet, the top sheet subsequently engaging an upper portion of the upright wall to cause a corner of the sheet to buckle as the top sheet is moved in the first direction, and a sheet feed block positioned laterally inwardly from the guide and lift tab and being positioned closely adjacent the top sheet in the stack as the too sheet is fed, the feed block having a surface that retains the top sheet adjacent to the stack of sheets to limit the size of the buckle as the top sheet is fed in the first direction.

2. The feeding arrangement of claim 1, wherein the guide and lift tab is mounted on a second upright wall that aligns with the leading edges of sheets in the stack, and provides a leading edge stop surface for sheets in the stack, prior to engagement of the sheets with the first mentioned upright wall, whereby force on a top sheet causes leading edges of the top sheet to move forwardly of the second wall as it is lifted.

3. The feeding arrangement of claim 2, wherein said first upright wall is spaced from the leading edge of the stack of sheets farther than the second upright wall supporting the guide and lift tab, the retainer portion having a flange with a side edge that tapers from an end of the flange that at least partially overlies the stack of sheets to a position inwardly from the lateral edge of the stack of sheets, and a downwardly inclined edge on the first upright wall for restraining and guiding the leading edge of at least the top sheet as the top sheet is fed in the first direction.

4. The feeding arrangement of claim 3 and an upright stop tab on an inner end of said tapered edge to catch the leading edge of the top sheet sliding on the tapered edge and cause a corner of the top sheet adjacent the leading edge to be restrained from movement in the first direction until other portions of the leading edge of the top sheet have moved in the first direction and the corner of the top sheet is pulled to clear the stop tab.

5. The feeding arrangement of claim 1, wherein there is a feed roller drive shaft mounted to extend across the stack of sheets and a feed block rotationally mounted on the feed roller drive shaft above the top sheet for controlling upward movement of portions of the top sheet, the sheet feed block being adjustable along the feed roller drive shaft.

6. The feeding arrangement of claim 5 and a guide plate mounted above the feed block and stopping rotation of the feed block at selected positions of the feed block along the feed roller drive shaft.

7. A sheet feeder arrangement for a sheet storage tray comprising a spring loaded plate for moving a stack of sheets toward a feeding position, and having corner catches at opposite corners of leading edges of first ends of the sheets in respect to a first direction of movement for feeding, the corner catches having first upright walls that face the leading edges of the sheets, wherein the improvement comprises a sheet stop and lift guide tab having a second upright wall facing the first ends of the sheets and in position to be engaged by movement of the sheets in the first direction, and having an upwardly inclined guide and lift tab portion that extends from the second upright wall in the first direction and is substantially aligned with upper sheets in the stack and tapers upwardly to a level above a top sheet in the stack, a feed roller engaging the top sheet in the stack of sheets, the sheet stop and lift guide being positioned inwardly from lateral side edges of the sheets whereby upon rotating the feed roller to feed a top sheet in the first direction, the top sheet is first lifted upwardly by action of the guide and lift tab to induce buckling of corner portions of the top sheet, and the corner portions of the top sheet then are restrained by the corner catches until the top sheet has been fed in the first direction a distance to pull the buckled corners of the leading edge of the top sheet clear of the corner catches, said corner catches each have a flange that overlies corner portions of the sheets in the stack, and wherein the top edges of the first upright walls of the corner catches taper downwardly from inner sides of such flanges in direction toward the stop and lift guide, respectively, and stop tab members protruding upwardly from the top edges of the first upright walls adjacent the inner edges of the upright walls to prevent sliding of the leading edge of the top sheet toward a center thereof more than a selected distance as the top sheet is fed.

8. The sheet feeder of claim 7, wherein the first upright walls of the corner catches have top edges that taper from a first highest position adjacent a lateral edge of the stack of sheets, and downwardly in direction toward the sheet stop and lift guide to lift portions of a leading edge of a top sheet and induce corner portions of the sheet to buckle under other portions of the top sheet as the top sheet is moved in the first direction.

9. The sheet feeder of claim 8 in combination with a feed block mounted to overlie the stack of sheets, said feed block having a surface to limit buckling movement of sheets under the top sheet as corner portions of the top sheet buckle.

10. The sheet feeder of claim 9, wherein the feed block is pivotally mounted above the stack of sheets and is adjustable laterally of the sheets and wherein there is a guide plate overlying the feed block to restrain pivotal movement of the feed block in substantially all lateral positions of the feed block, the guide plate having an opening through which the feed block may move for limited pivoting in at least one lateral position.

11. The sheet feeder of claim 4, wherein said top edges of the first upright walls of the corner catches have two different inclination angles relative to a plane of sheets in the stack, a first angle edge forming a steeply inclined edge adjacent the flanges of the corner catches, and a smaller inclination angle edge extending from the first angle edge to the inner edge of the first upright wall.

12. A single sheet feeder for a storage tray comprising catches for sheets being fed in a first direction at each corner of a front edge of the sheets adjacent lateral sides thereof, the catches comprising first upright walls at the corners supporting overlying flanges, said first upright walls each having a tapered upper edge leading from the respective flanges toward a center portion of the sheets, a stop lug at an end of each said upper edge spaced inwardly toward the center portion, and a pair of stop and lift guides mounted inwardly of the stop lugs of respective catches and having second upright walls for preventing movement in the first direction of sheets aligned with said second upright walls, and the stop and lift guides having upwardly inclined guide and lift tabs extending from the respective second upright walls in the first direction and being positioned at a location so that rounded corners formed between the second upright walls and the respective inclined guide and lift tabs lift portions of sheets being fed from the storage tray.

13. The sheet feeder of claim 12, wherein said second upright walls are positioned closer to leading edges of a stack of sheets in the storage tray than the corner catch first upright walls, such that sheets being fed engage the rounded corner and are lifted by the upwardly inclined guide and lift tabs prior to engaging the upright edges of the first upright walls of the corner catches, the lifting of the sheets being fed inducing corners of a top sheet to buckle as the top sheet is fed in a first direction.

14. The sheet feeder of claim 13, used in combination with a cross shaft lying above the stack of sheets in the storage tray, and having feed rollers for engaging a top sheet for frictionally driving the top sheet in the first direction, and sheet feed blocks positioned to limit the upward movement of the top sheet, said sheet feed blocks being positioned inwardly toward a center of the stack of sheets from the stop and lift guides.

15. The sheet feeder of claim 14, wherein the guide and lift tabs protrude upwardly to align with and engage a second sheet dragged by said top sheet in the first direction.

* * * * *

UNITED STATES PATENT AND TRADEMARK OFFICE

CERTIFICATE OF CORRECTION

PATENT NO. : 5,984,295

DATED : November 16, 1999

INVENTOR(S) : Todd A. Britz

It is certified that error appears in the above-identified patent and that said Letters Patent is hereby corrected as shown below: Column 8, Claim 11, line 1, cancel "4" and insert "7".

Signed and Sealed this

Twelfth Day of September, 2000

*Attest:*

Q. TODD DICKINSON

*Attesting Officer*

*Director of Patents and Trademarks*